US011560673B2

(12) United States Patent
Chen et al.

(10) Patent No.: US 11,560,673 B2
(45) Date of Patent: Jan. 24, 2023

(54) PULP MOLDING PRODUCTION LINE AND PROCESSING METHOD THEREOF

(71) Applicant: Be Green Packaging, LLC, Ridgeland, SC (US)

(72) Inventors: Shu Chen, Zhejiang (CN); Gang Cen, Zhejiang (CN)

(73) Assignee: BE GREEN PACKAGING LLC, Ridgeland, SC (US)

( * ) Notice: Subject to any disclaimer, the term of this patent is extended or adjusted under 35 U.S.C. 154(b) by 0 days.

(21) Appl. No.: 16/709,039

(22) Filed: Dec. 10, 2019

(65) Prior Publication Data

US 2020/0248407 A1 Aug. 6, 2020

(30) Foreign Application Priority Data

Jan. 31, 2019 (CN) ..... 201910098112.8

(51) Int. Cl.
*D21F 13/12* (2006.01)
*D21F 2/00* (2006.01)
(Continued)

(52) U.S. Cl.
CPC ..... *D21F 13/12* (2013.01); *D21F 2/00* (2013.01); *D21F 3/0272* (2013.01); *D21F 7/02* (2013.01); *D21J 3/00* (2013.01)

(58) Field of Classification Search
CPC ..... D21F 13/12; D21F 2/00; D21F 3/0272; D21F 7/02; D21J 7/00; D21J 3/00; D21J 3/10; B65D 81/02; B65D 43/0212
See application file for complete search history.

(56) References Cited

U.S. PATENT DOCUMENTS 1,163,005 A 12/1915 Hall
2,879,935 A 3/1959 Carter
(Continued)

FOREIGN PATENT DOCUMENTS

CN 87206542 9/1988
CN 2035341 4/1989
(Continued)

OTHER PUBLICATIONS

US, Restriction Requirement, U.S. Appl. No. 15/844,556, 6 pages (dated Jul. 1, 2019).
(Continued)

*Primary Examiner* — Eric Hug
*Assistant Examiner* — Matthew M Eslami
(74) *Attorney, Agent, or Firm* — Thompson Hine LLP

(57) ABSTRACT

A pulp molding production line including as molding machine, pulp molding robot and press, where a transfer device installed on the pulp molding robot includes a wet pulp transfer mold, with the front of the wet pulp transfer mold including a recessed matching chamber configured to fit over the exterior of a wet pulp product, and a moving rack oriented parallel to the wet pulp transfer mold and connected to the back of the wet pulp transfer mold through a guide mechanism, with a driver connected between the back of the wet pulp transfer mold and the moving rack to drive the moving rack to move relative to the wet pulp transfer mold, and several evenly spaced vacuum chucks provided on a side of the moving rack opposite from the wet transfer mold to acquire the molded pulp product from the press.

14 Claims, 11 Drawing Sheets

(51) Int. Cl.

| | |
|---|---|
| ***D21F 3/02*** | (2006.01) |
| ***D21F 7/02*** | (2006.01) |
| ***D21J 3/00*** | (2006.01) |

(56) References Cited

U.S. PATENT DOCUMENTS

| | | | |
|---|---|---|---|
| 3,065,875 | A | 11/1962 | Negoro |
| 5,628,402 | A | 5/1997 | Dickie et al. |
| 5,678,692 | A | 10/1997 | Gratz |
| 6,082,543 | A | 7/2000 | Beliveau |
| RE37,253 | E | 7/2001 | Moren et al. |
| 6,405,866 | B2 | 6/2002 | Arima |
| 6,576,089 | B1 | 6/2003 | Sato et al. |
| 6,918,997 | B2 | 7/2005 | Goto et al. |
| 8,511,473 | B1 | 8/2013 | Bontrager et al. |
| 8,701,891 | B2 | 4/2014 | Bontrager et al. |
| 9,138,898 | B2 | 9/2015 | Liu |
| 2003/0051845 | A1 | 3/2003 | Gale et al. |
| 2003/0111201 | A1 | 6/2003 | Sato et al. |
| 2004/0055928 | A1 | 3/2004 | Smith |
| 2004/0084166 | A1 | 5/2004 | Nanomura et al. |
| 2006/0131788 | A1 | 6/2006 | Takigawa |
| 2010/0294448 | A1 | 11/2010 | Pierce et al. |
| 2011/0113622 | A1 | 5/2011 | Liu |
| 2013/0134069 | A1 | 5/2013 | Babey et al. |
| 2015/0292154 | A1* | 10/2015 | Zheng ..... D21F 9/04 162/226 |
| 2018/0086511 | A1 | 3/2018 | Lin |
| 2019/0010663 | A1 | 1/2019 | Chen et al. |

FOREIGN PATENT DOCUMENTS

| | | | |
|---|---|---|---|
| CN | 2055127 | | 3/1990 |
| CN | 2138642 | | 7/1993 |
| CN | 2439458 | Y | 7/2001 |
| CN | 1423719 | | 6/2003 |
| CN | 2832697 | Y | 11/2006 |
| CN | 102465477 | A | 5/2012 |
| CN | 102733268 | A | 10/2012 |
| CN | 202595578 | U | 12/2012 |
| CN | 101961921 | B | 3/2013 |
| CN | 102059706 | B | 8/2013 |
| CN | 203622422 | U | 6/2014 |
| CN | 203668762 | U | 6/2014 |
| CN | 204263176 | U | 4/2015 |
| CN | 204264636 | | 4/2015 |
| CN | 105253621 | A | 1/2016 |
| CN | 205387641 | U | 7/2016 |
| CN | 106436489 | A | 2/2017 |
| CN | 206142441 | U | 5/2017 |
| CN | 107059491 | A | 8/2017 |
| CN | 107195954 | A | 9/2017 |
| CN | 206590564 | U | 10/2017 |
| CN | 107915044 | A | 4/2018 |
| CN | 207259870 | U | 4/2018 |
| CN | 207404482 | U | 5/2018 |
| CN | 108130824 | A | 6/2018 |
| CN | 108396595 | A | 8/2018 |
| CN | 108457132 | A | 8/2018 |
| CN | 208072083 | U | 11/2018 |
| CN | 208072083 | U * | 11/2018 |
| CN | 208121482 | U | 11/2018 |
| CN | 208658569 | U | 3/2019 |
| CN | 110216710 | A | 9/2019 |
| CN | 110219210 | A | 9/2019 |
| CN | 209599250 | U | 11/2019 |
| CN | 209619753 | U | 11/2019 |
| EP | 0798225 | | 10/1997 |
| EP | 1 074 657 | | 2/2001 |
| EP | 1 285 994 | | 2/2003 |
| JP | 2001254300 | A | 9/2001 |
| JP | 2001303498 | A | 10/2001 |
| JP | 2007039093 | A | 2/2007 |
| TW | M538917 | U | 4/2017 |
| TW | 610007 | | 1/2018 |
| WO | 03/014471 | | 2/2003 |
| WO | 2010/124300 | | 10/2010 |
| WO | 2018/216544 | A1 | 11/2018 |
| WO | 2019/141117 | | 7/2019 |

OTHER PUBLICATIONS

US, Non-Final Office Action; U.S. Appl. No. 15/844,556, 9 pages (dated Sep. 19, 2019).

US, Final Office Action; U.S. Appl. No. 15/844,556, 6 pages (dated Feb. 12, 2020).

US, Notice of Allowance, U.S. Appl. No. 13/559,132, 7 pages (dated Jun. 27, 2013).

US, Notice of Allowance, U.S. Appl. No. 13/970,232, 8 pages (dated Dec. 4, 2013).

PCT, International Search Report with English translation, and Written Opinion, PCT Patent Application No. PCT/CN2019/070942, 11 pages (dated Apr. 8, 2019).

China National Intellectual Property Administration (ISA/CN), International Search Report (with English translation), International Application No. PCT/CN2019/128104, 6 pages, dated Mar. 18, 2020.

China National Intellectual Property Administration (ISA/CN), Written Opinion of the International Searching Authority (with English translation), International Application No. PCT/CN2019/128104, 9 pages, dated Mar. 18, 2020.

China National Intellectual Property Administration (ISA/CN), International Search Report (with English translation), International Application No. PCT/CN2019/128103, 8 pages, dated Mar. 19, 2020.

China National Intellectual Property Administration (ISA/CN), Written Opinion of the International Searching Authority (with English translation), International Application No. PCT/CN2019/128103, 8 pages, dated Mar. 19, 2020.

U.S. Patent and Trademark Office, Non-Final Office Action, U.S. Appl. No. 16/709,317, 13 pages, dated Aug. 11, 2021.

U.S. Patent and Trademark Office, Final Office Action, U.S. Appl. No. 16/709,317, 10 pages, dated May 6, 2022.

U.S. Patent and Trademark Office, Advisory Action, U.S. Appl. No. 16/709,317, 3 pages, dated Jul. 18, 2022.

* cited by examiner

PULP MOLDING PRODUCTION LINE AND PROCESSING METHOD THEREOF

CROSS-REFERENCE TO RELATED APPLICATIONS

This application claims priority to Chinese Patent Application No. 201910098112.8, filed on Jan. 31, 2019 and titled "Pulp Molding Production Line and Processing Method Thereof," which is incorporated herein by reference in its entirety.

FIELD

The present invention relates to the field of pulp molding machinery technologies, and in particular relates to a pulp molding production line and a production line and a processing method thereof.

DESCRIPTION OF THE RELATED ART

During a production process, a pulp molding product needs to be subjected to cold extrusion and hot molding, and a robot is used to transfer the material between the cold extrusion and hot molding.

Existing robots for pulp molding production are typically installed with transfer mold fixtures for transferring pulp molded wet pulp products onto molds or for obtaining and releasing press-molded products. Namely, only one action can be executed each time, and it is impossible to simultaneously complete wet pulp transfer and obtaining and releasing of a product, leading to low production efficiency.

Therefore, for example, the Chinese Patent Application No. 201320735610.7 discloses a transport robot for a pulp molding machine. The robot has three degrees of freedom and can move in three directions of X, Y, and Z. The movement in the X direction (lateral movement) is implemented by two rod-less cylinders and straight guide tracks, and positioning in three states can be accurately achieved; the movement in the Y direction (translation) and the movement in the Z direction (vertical movement) are implemented by a motor and screw rods, and any position within the stroke range can be accurately determined. The grab and release of steel trays are implemented through power on and off of electromagnets. The robot can use a tray to directly receive products produced by a pulp molding machine from a mold, and then place the products sequentially on a cart for unified drying processing on the products. The robot has features of simple structure, easy manufacturing, low cost, and stable performance, and can replace human labor to save manpower and production cost.

Despite of the above numerous advantages, the above solution does not solve the above-described technical problems.

SUMMARY

For the above problems, the objective of the present invention is to provide a pulp molding production line and a processing method thereof that can significantly improve the production efficiency.

To achieve the above objective, the present invention adopts the following technical solutions:

A pulp molding production line, comprising at least one molding machine and pulp molding robot and at least one press, wherein the molding machine, the pulp molding robot and the press are sequentially arranged, a transfer device is installed on the pulp molding robot, the transfer device acquires a wet pulp product molded by the molding machine and transfers the same to the press, and acquires a pulp product molded by the press, and transfers and releases the same, the transfer device comprises a wet pulp transfer mold provided with a sealed gas chamber therein, the front of the wet pulp transfer mold is provided with at least one recessed matching chamber that can fit over the external of a wet pulp product and is recessed to the sealed gas chamber side, the recessed matching chamber matches the wet pulp product, several interfacing apertures for communicating or connecting the recessed matching chamber with the sealed gas chamber are respectively formed on the inner wall of each recessed matching chamber and the bottom of the recessed matching chamber, the interfacing apertures formed on the inner wall of the recessed matching chamber are evenly distributed in a circle and surround to form at least one circle, the interfacing apertures formed on the bottom of the recessed matching chamber are evenly distributed in a circle and surround to form at least one circle, a moving rack parallel to the wet pulp transfer mold is connected to the back of the wet pulp transfer mold through a guide mechanism, a driver is connected between the back of the wet pulp transfer mold and the moving rack, the driver drives the moving rack to move relative to the wet pulp transfer mold, several evenly spaced vacuum chucks are provided on the moving rack, and the vacuum chucks and the sealed gas chamber are connected to a vacuumizing system, respectively.

Preferably, two rounds of the interfacing apertures are formed on the bottom of the recessed matching chamber, and several interfacing apertures are evenly distributed in a circle and surround to form each round.

Preferably, a central hole is formed in the center of the bottom of the recessed matching chamber for communicating or connecting the recessed matching chamber with the sealed gas chamber.

Preferably, the wet pulp transfer mold comprises a main template provided with a chamber on the back thereof, the chamber has an opening in communication with the surroundings, several recessed matching chambers are arranged on the front of the main template and distributed in an array, several interfacing apertures for communicating or connecting the recessed matching chambers with the sealed gas chamber are respectively formed on the inner wall of each recessed matching chamber and the bottom of the recessed matching chamber, several internal projections are provided at the internal bottom of the chamber for one-to-one correspondence to the recessed matching chambers, the interfacing apertures run through the internal projections, the wet pulp transfer mold further comprises a sealing template for sealing the opening of the chamber, and the above sealed gas chamber is formed between the main template and the sealing template.

Preferably, a reinforcing support structure is provided at the bottom of the chamber and is in contact with one surface of the sealing template close to the chamber.

Preferably, the reinforcing support structure comprises several reinforcing support projections I evenly spaced apart laterally and several reinforcing support projections II evenly spaced apart longitudinally, the reinforcing support projections I are disposed on the same straight line and at the lateral central position of the chamber, the reinforcing support projections II are disposed on the same straight line and at the longitudinal central position of the chamber, the reinforcing support projections I and the reinforcing support projections II form a cross, one ends of the reinforcing support projections I away from the bottom of the chamber abut against one surface of the sealing template close to the chamber, and one ends of the reinforcing support projections II away from the bottom of the chamber abut against one surface of the sealing template close to the chamber.

Preferably, a support plane I is provided at the end of each reinforcing support projection I abutting against the sealing template, a support plane II is provided at the end of each reinforcing support projection II abutting against the sealing template, and the support plane I and the support plane II are located within the same horizontal plane.

Preferably, several sequentially connected curved concaves are formed on the inner wall of the chamber, and the outermost internal projections of the above internal projections correspond, one to one, to the curved concaves.

Preferably, the guide mechanism comprises several guide columns parallel to each other and with one end fixed to the back of the wet pulp transfer mold, several guide sleeve fixing holes are provided on the moving rack and guide sleeves fixed on the guide sleeve fixing holes, the guide sleeves fit over the guide columns one by one, and the guide sleeves and the guide columns are in a sliding connection.

Preferably, six recessed matching chambers are treated as one region, and four of such regions are provided on the front of the wet pulp transfer mold.

Preferably, two adjacent reinforcing support projections I are connected via an arc connecting rib I therebetween, there are two reinforcing support projections II disposed at the outer sides of the reinforcing support projection I in the very middle, and each of the reinforcing support projections II is connected to the reinforcing support projection I in the very middle via an arc connecting rib II therebetween.

Preferably, the main template and the sealing template are connected via a removable connection structure.

Preferably, the removable connection structure comprises a ring-shaped shoulder arranged on the circumference of the main template, the thickness of the ring-shaped shoulder is smaller than the thickness of the main template, the back of the main template is flush with the back of the ring-shaped shoulder, each side of the sealing template is provided with locking bolts that run through the side, the locking bolts run through screw holes of the ring-shaped shoulder, locking nuts fit onto the locking bolts, and the locking nuts contact the front of the ring-shaped shoulder.

Preferably, a receding notch is formed on the front of the ring-shaped shoulder for communication with the screw holes, and the locking nuts are disposed inside the receding notch and contact the bottom surface of the receding notch.

The molding machine is the prior art.

The press comprises a lower base, four vertical guide columns connected to the top of the lower base, an upper mold seat connected to the top ends of the four vertical guide columns, and a movable lower mold seat disposed right underneath the upper mold seat and movably connected to the vertical guide columns, the movable lower mold seat is connected to a press main cylinder, the press main cylinder drives the movable lower mold seat to move up and down axially along the vertical guide columns, characterized in that the press further comprises an auxiliary rack arranged between the movable lower mold seat and the upper mold seat, and the auxiliary rack is connected to a lifting drive mechanism.

The auxiliary rack fits over the transfer device, and under the action of an external force, the auxiliary rack assists the transfer device to move up and down.

The auxiliary rack comprises an auxiliary push board, four guide round holes are formed on the edge of the auxiliary push board for the vertical guide columns to run through one by one, the auxiliary push board is formed with a polygonal central through hole, and the guide round holes are disposed on the periphery of the polygonal central through hole.

Preferably, the polygonal central through hole is an octagonal through hole.

Preferably, the rim of the auxiliary push board is formed with external edges corresponding, one to one, to the hole walls of the octagonal through hole, and the external edges form an octagon.

Preferably, the reinforcing structure comprises a lateral reinforcing rib connected between the two cantilever bosses, the lateral reinforcing rib is connected to an outer wall of the auxiliary push board, and a longitudinal reinforcing rib is provided in the middle portion of the lateral reinforcing rib, and the inner end of the longitudinal reinforcing rib is connected to the outer wall of the auxiliary push board.

Preferably, an arc chamfer I is respectively formed at the upper hole opening and the lower hole opening of the octagonal through hole, and an arc chamfer II is respectively formed at two sides of each external edge.

Preferably, the lifting drive mechanism comprises two fixed frames that are respectively fixed to the top of the lower base, a cylinder I is fixed inside each fixed frame, and telescopic rods of the cylinder I extend upwardly and are connected, one by one, to the middle portion of the lower surface of the lateral reinforcing rib.

The cylinder I may be replaced by an oil cylinder or a linear motor.

Preferably, the fixed frame comprises a rectangular frame and is fixed vertically, a strip hole I is formed in the central region of the top end of the fixed frame, a strip hole II is formed in the central region of the bottom end of the fixed frame, the telescopic rod of the cylinder I runs through the strip hole I and the top end of the cylinder body of the cylinder I is sleeved with a fixed board, the fixed board is arranged on the top surface of the hole opening of the strip hole I, several bolts I run through the fixed board, the bolts I are in threaded connection with threaded holes at the top of the fixed frame, and the bottom end of the cylinder I runs through the strip hole II.

Compared with the prior art, the present invention has the following advantages:

1. Compared with the prior art, wet pulp transfer and product acquisition can be performed at the same time, and the robot does not need to move. The direct-acting device inside the device extends chucks over product molds, takes out the products, and then achieves the objective of simultaneously transferring wet pulp and products, thereby significantly improving the production efficiency.

2. The transfer device has a simple structure and low manufacturing cost.

3. The production line significantly improves the production efficiency.

4. The lifting drive mechanism drives the auxiliary push board to move up and down between the movable lower mold seat and the upper mold seat, and at this moment, the transfer device connected to the robot may be forced, by the action of the auxiliary push board, to move up or down, the robot does not need to further execute the upward or downward pushing action, and the reliability of robot operations can be ensured. At the same time, the service life of the robot is extended, such that the production can continuously and steadily proceed, which further meets the production requirements of enterprises.

Figure 1:
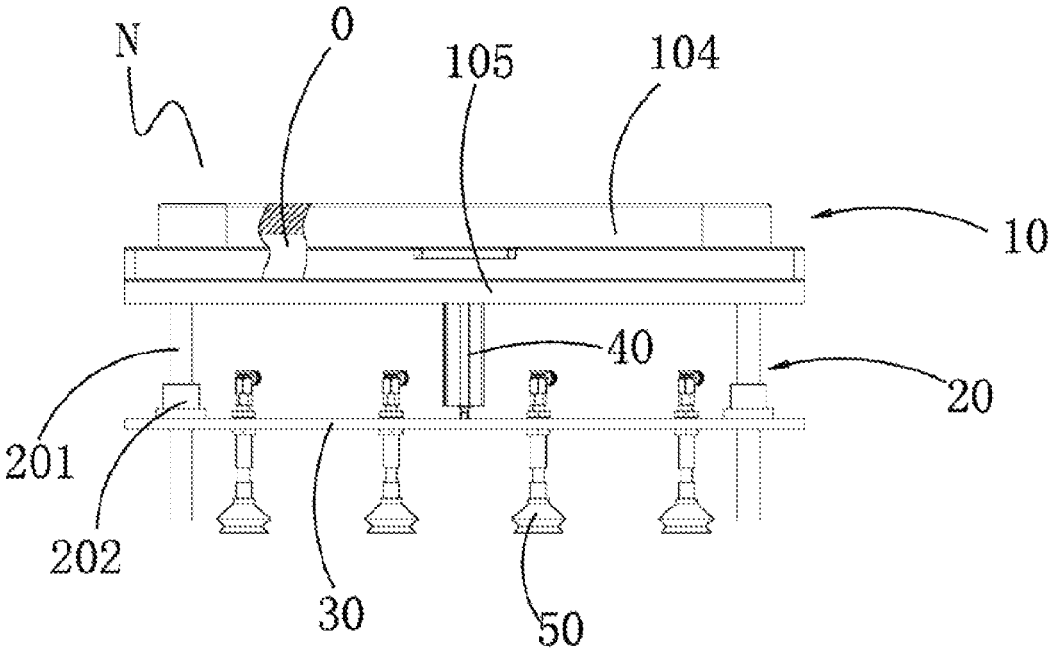
FIG. 1 is a schematic structural diagram of the transfer device according to the present invention.

The figures include, sealed gas chamber 0, wet pulp transfer mold 10, recessed matching chamber 101, interfacing aperture 102, central hole 103, main template 104, chamber 1041, internal projection 1042, reinforcing support projection I 1043, reinforcing support projection II 1044, support plane I 1045, support plane II 1046, curved concave 1047, arc connecting rib I 1048, arc connecting rib II 1049, sealing template 105, ring-shaped shoulder 106, receding notch 107, guide mechanism 20, guide column 201, guide sleeve 202, moving rack 30, driver 40, vacuum chuck 50, vacuumizing system 60, pulp molding robot 3*a*, press 2*a*, transfer device Q, auxiliary rack N, auxiliary push board 1, polygonal central through hole 11, arc chamfer I 111, arc chamfer II 112, cantilever boss 12, guide round hole 121, reinforcing structure 13, lateral reinforcing rib 131, longitudinal reinforcing rib 132, lower base 2, vertical guide column 21, upper mold seat 3, movable lower mold seat 4, press main cylinder 41, lifting drive mechanism 5, fixed frame 51, strip hole I 511, strip hole II 512, fixed board 513, bolt I 514, and cylinder I 52.

DETAILED DESCRIPTION

The technical solutions of the present invention will be further described below with reference to specific embodiments and the accompanying drawings. However, the present invention is not limited to these embodiments.

Figure 8:
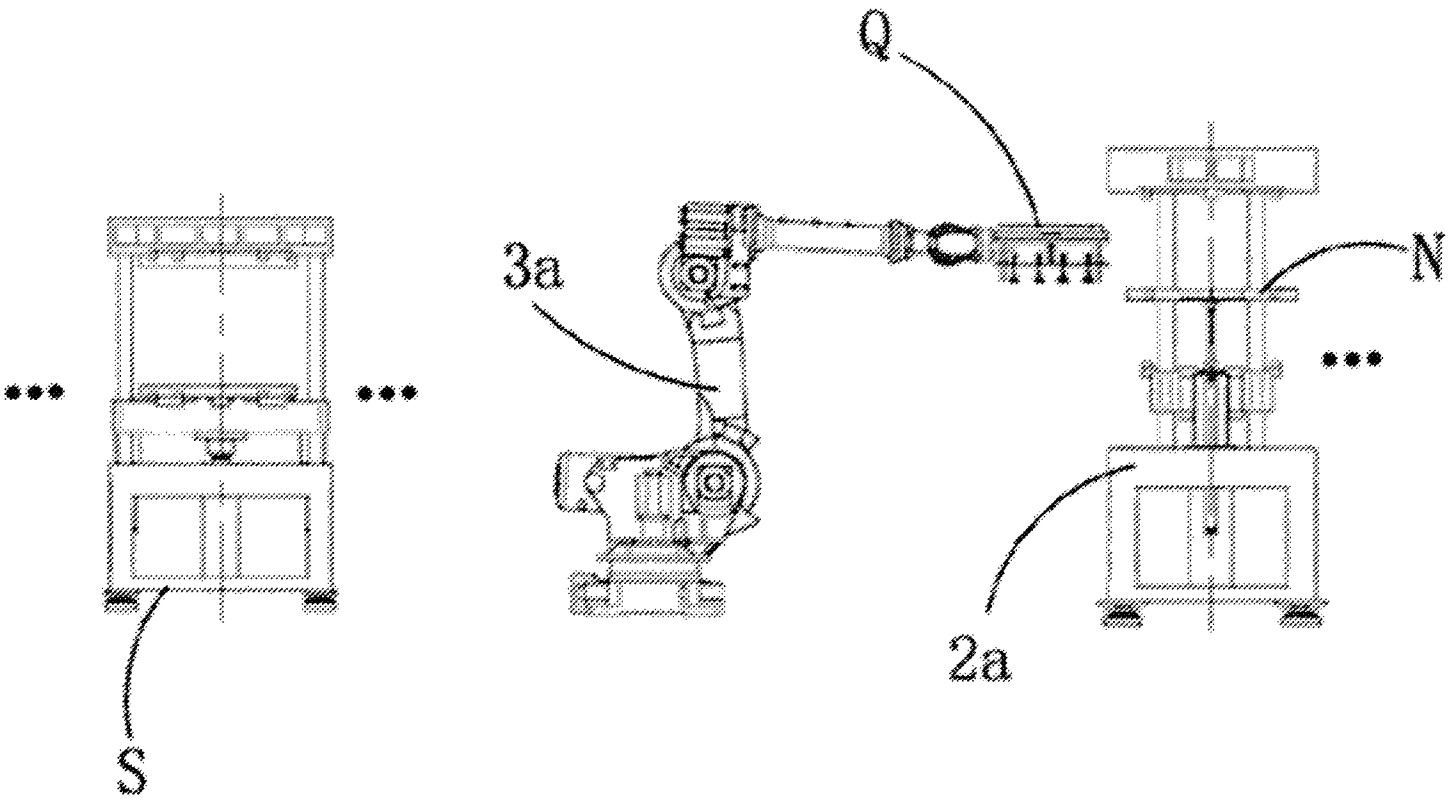
FIG. 8 is a schematic structural diagram of the production line according to the present invention.
Figure 9:
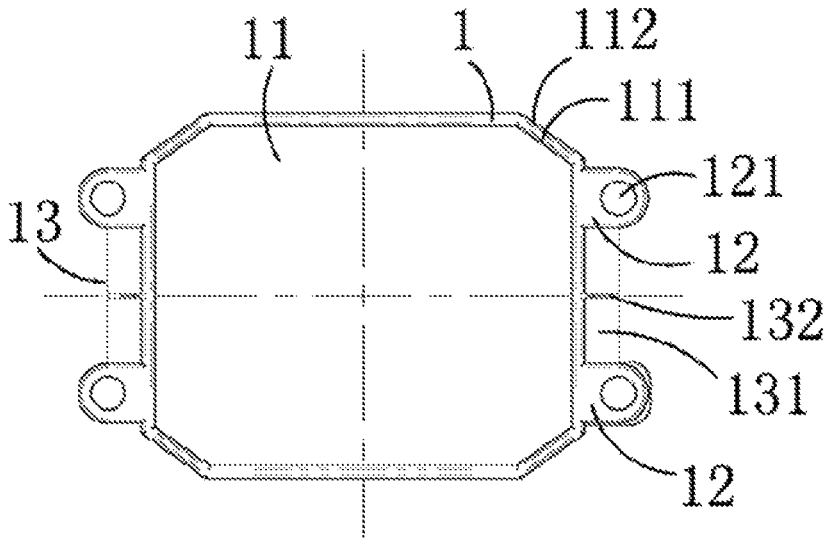
FIG. 9 is a schematic structural diagram of the auxiliary rack according to the present invention.
Figure 10:
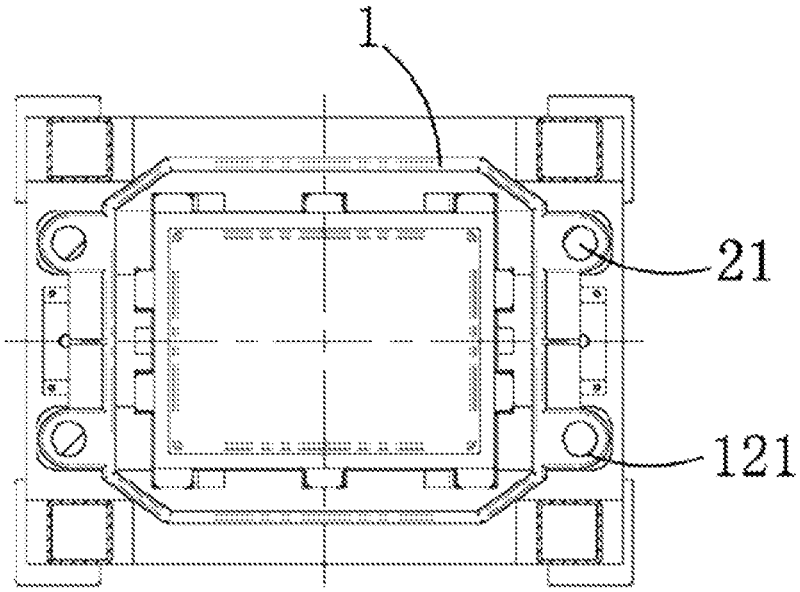
FIG. 10 is a schematic structural diagram after the auxiliary rack is installed on the press according to the present invention.
Figure 11:
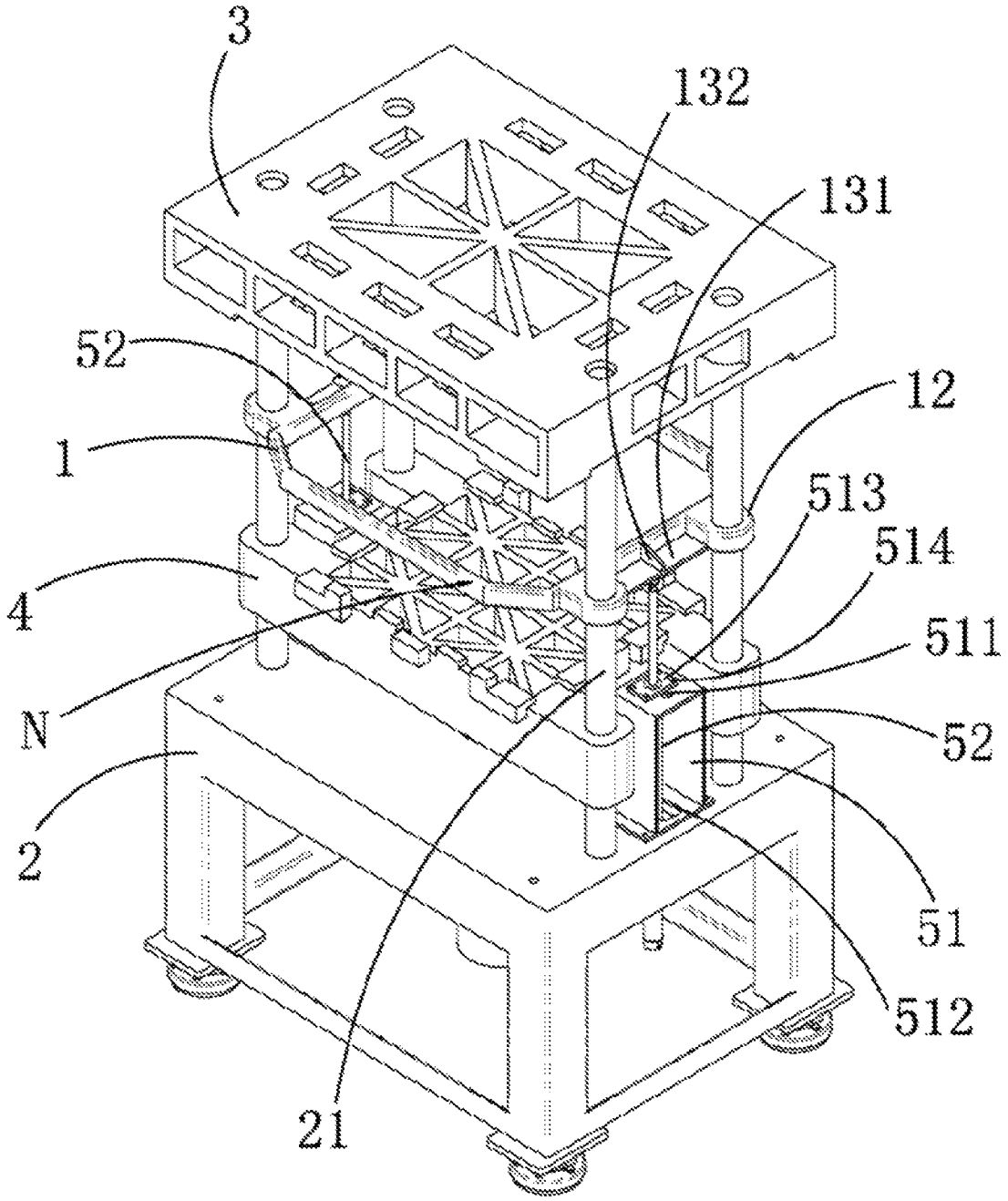
FIG. 11 is a 3-D schematic structural diagram of the press according to the present invention.
Figure 12:
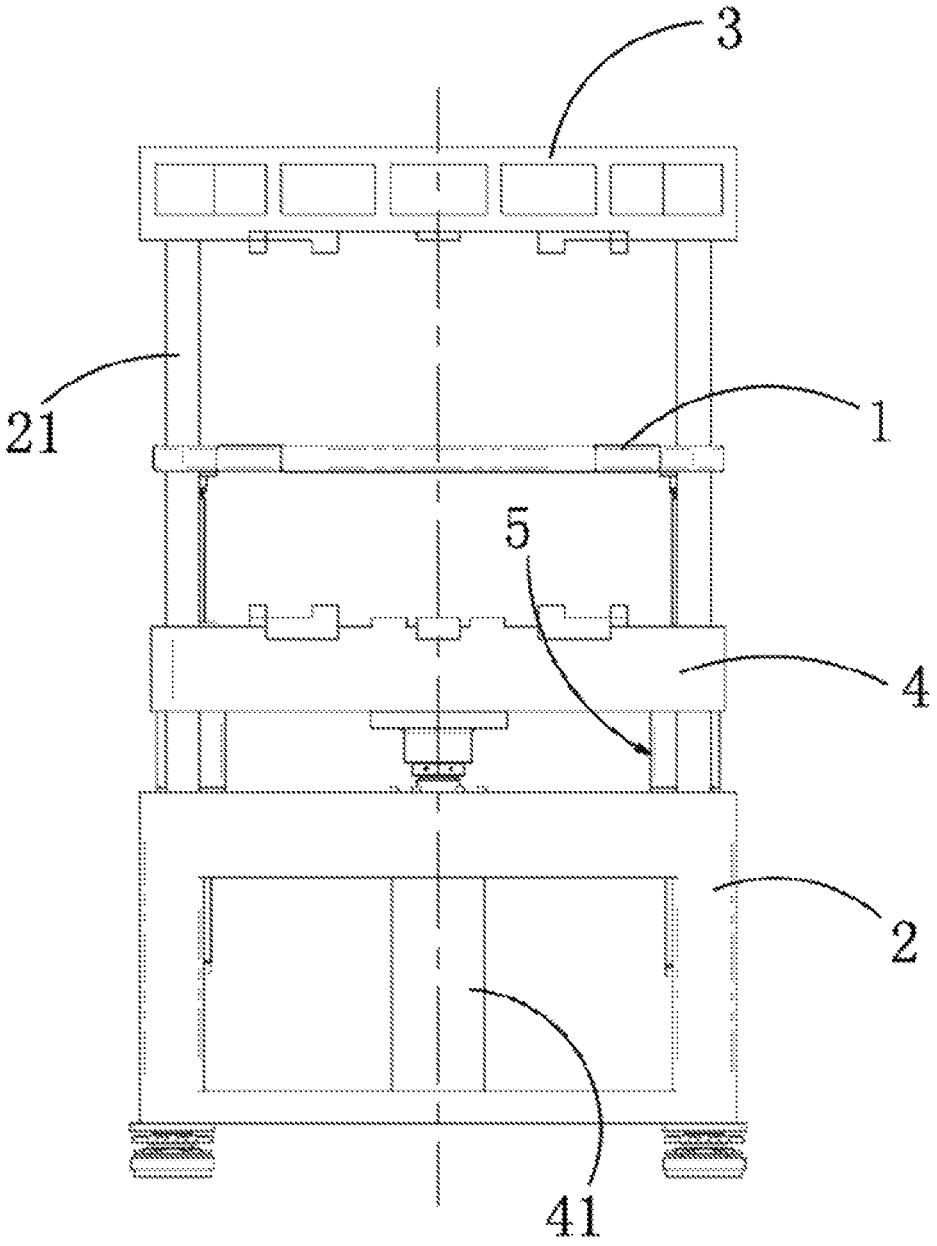
FIG. 12 is a schematic structural diagram of the press according to the present invention.

As shown in FIG. 8:

A pulp molding production line comprises at least one molding machine S and pulp molding robot 3*a* and at least one press 2*a*, wherein the molding machine, the pulp molding robot and the press are sequentially arranged, a transfer device Q is installed on the pulp molding robot, the transfer device acquires a wet pulp product molded by the molding machine and transfers the same to the press, and acquires a pulp product molded by the press, and transfers and releases the same.

Figure 13:
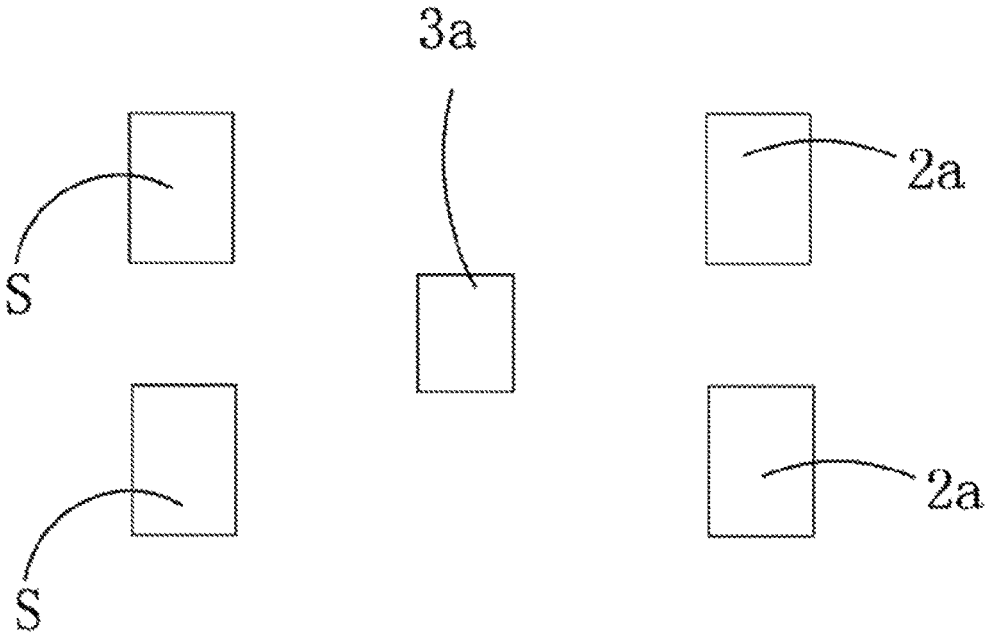
FIG. 13 is a block diagram of a simplified distribution state I of the production line according to the present invention.
Figure 14:
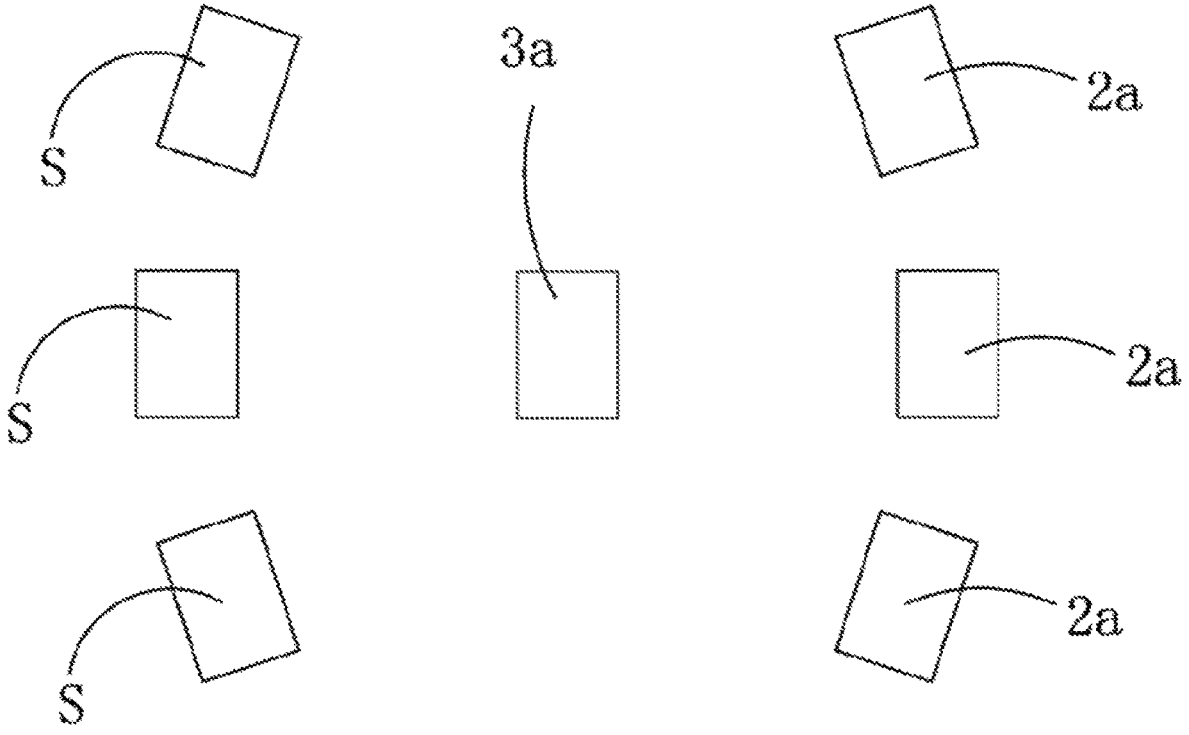
FIG. 14 is a block diagram of a simplified distribution state II of the production line according to the present invention.

As shown in FIGS. 13-14, there are several molding machines S. In the case of two, the two are arranged to be spaced apart. In the case of three, the three are distributed in one row, in a triangle, or an arc. In the case of four, the three are distributed in one row or an arc.

Similarly, the presses 2*a* are distributed in the same way as the molding machines S are.

There are also many ways of distribution, which will not be enumerated herein.

As shown in FIGS. 1-7:

The transfer device comprises a wet pulp transfer mold 10 provided with a sealed gas chamber 0 therein, the front of the wet pulp transfer mold 10 is provided with at least one recessed matching chamber 101 that can fit over the external of a wet pulp product and is recessed to the side of the sealed gas chamber 0, and the recessed matching chamber 101 matches the wet pulp product. Such structure can expand the contact surface with the wet pulp product, and can improve the material taking efficiency and stability.

Several interfacing apertures 102 for communicating or connecting the recessed matching chamber 101 with the sealed gas chamber 0 are respectively formed on the inner wall of each recessed matching chamber 101 and the bottom of the recessed matching chamber 101, the interfacing apertures 102 formed on the inner wall of the recessed matching chamber 101 are evenly distributed in a circle and surround to form at least one circle, and the interfacing apertures 102 formed on the bottom of the recessed matching chamber 101 are evenly distributed in a circle and surround to form at least one circle. By designing at least one circle of the interfacing apertures 102 at different positions, the material stability can be ensured.

In an optimized solution, two rounds of the interfacing apertures 102 are formed on the bottom of the recessed matching chamber 101 in the present embodiment, and several interfacing apertures 102 are evenly distributed in a circle and surround to form each round.

Next, a central hole 103 is formed in the center of the bottom of the recessed matching chamber 101 for communicating or connecting the recessed matching chamber 101 with the sealed gas chamber 0.

A moving rack 30 parallel to the wet pulp transfer mold 10 is connected to the back of the wet pulp transfer mold 10 through a guide mechanism 20. The guide mechanism 20 here comprises several guide columns 201 parallel to each other and with one end fixed to the back of the wet pulp transfer mold 10, several guide sleeve fixing holes are provided on the moving rack 30 and guide sleeves 202 fixed on the guide sleeve fixing holes, the guide sleeves 202 fit over the guide columns 201 one by one, and the guide sleeves 202 and the guide columns 201 are in a sliding connection.

The coordination and engagement between the guide sleeves 202 and the guide columns 201 can further improve the smoothness and stability of the lifting.

A driver 40 is connected between the back of the wet pulp transfer mold 10 and the moving rack 30, the driver 40 drives the moving rack 30 to move relative to the wet pulp transfer mold 10, and the driver 40 is any one of a cylinder, an oil cylinder, and a linear motor.

Several evenly spaced vacuum chucks 50 are provided on the moving rack 30, and the vacuum chucks 50 and the sealed gas chamber 0 are connected to a vacuumizing system 60, respectively. The vacuumizing system 60 comprises a vacuumizing pipeline and a vacuumizing device connected to the vacuumizing pipeline. The vacuumizing device is purchased from the market.

Namely, when the vacuumizing device vacuumizes, the sealed gas chamber 0 is forced to be vacuumized. At this moment, the wet pulp product can be sucked by means of the interfacing apertures 102 and the central hole 103 and transferred into the molding mold, i.e., into the upper mold or the lower mold of the molding mold. At the same time, the vacuum chucks 50 can move up or down under the action of the driver, thereby sucking the pulp molding product molded by the molding mold, and the transfer, acquiring and releasing actions can be completed simultaneously, which significantly improves the production efficiency.

It just needs to change vacuum to air blowing for releasing.

Specifically, the wet pulp transfer mold 10 in the present embodiment comprises a main template 104 provided with a chamber 1041 on the back thereof, the chamber 1041 has an opening in communication with the surroundings, several recessed matching chambers 101 are arranged on the front of the main template 104 and distributed in an array, several interfacing apertures 102 for communicating or connecting the recessed matching chambers 101 with the sealed gas chamber 0 are respectively formed on the inner wall of each recessed matching chamber 101 and the bottom of the recessed matching chamber 101, several internal projections 1042 are provided at the internal bottom of the chamber 1041 for one-to-one correspondence to the recessed matching chambers 101, the interfacing apertures 102 run through the internal projections 1042, the wet pulp transfer mold 10 further comprises a sealing template 105 for sealing the opening of the chamber 1041, and the above sealed gas chamber 0 is formed between the main template 104 and the sealing template 105.

The internal projections 1042 correspond to the recessed matching chambers 101, which can facilitate the development of molds and lower the manufacturing difficulty.

The wet pulp is not limited to the upper mold S1, and the product is not limited to the lower mold S2. In other words, the wet pulp can be transferred to either the upper mold or the lower mold, and corresponding product is taken out from the lower mold or the upper mold. The same device can achieve this objective by installing the device in a proper way or a reversed way or by reversing the end joint of the robot.

The transfer of a wet pulp or product is achieved by vacuum suction. There is a sealed gas chamber inside the wet pulp module, the gas chamber is then connected to the vacuum pipeline, and the chucks are connected to the vacuum pipeline. To release the wet pulp or product, vacuum just needs to be changed to air blowing.

Figure 2:
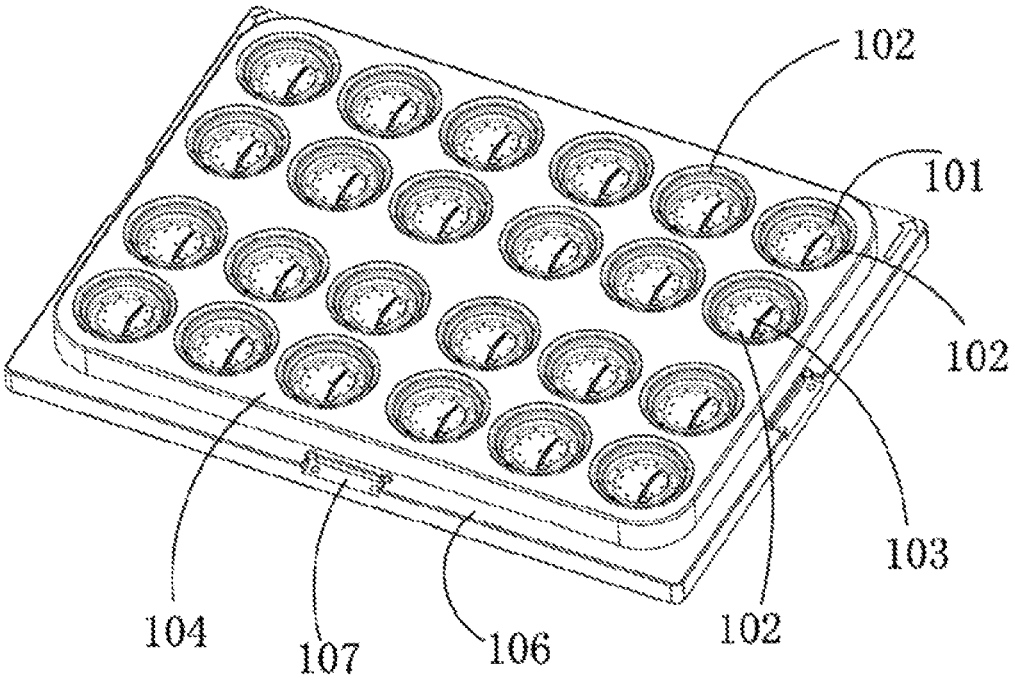
FIG. 2 is a schematic structural diagram of the front of the main template of the transfer device according to the present invention.
Figure 3:
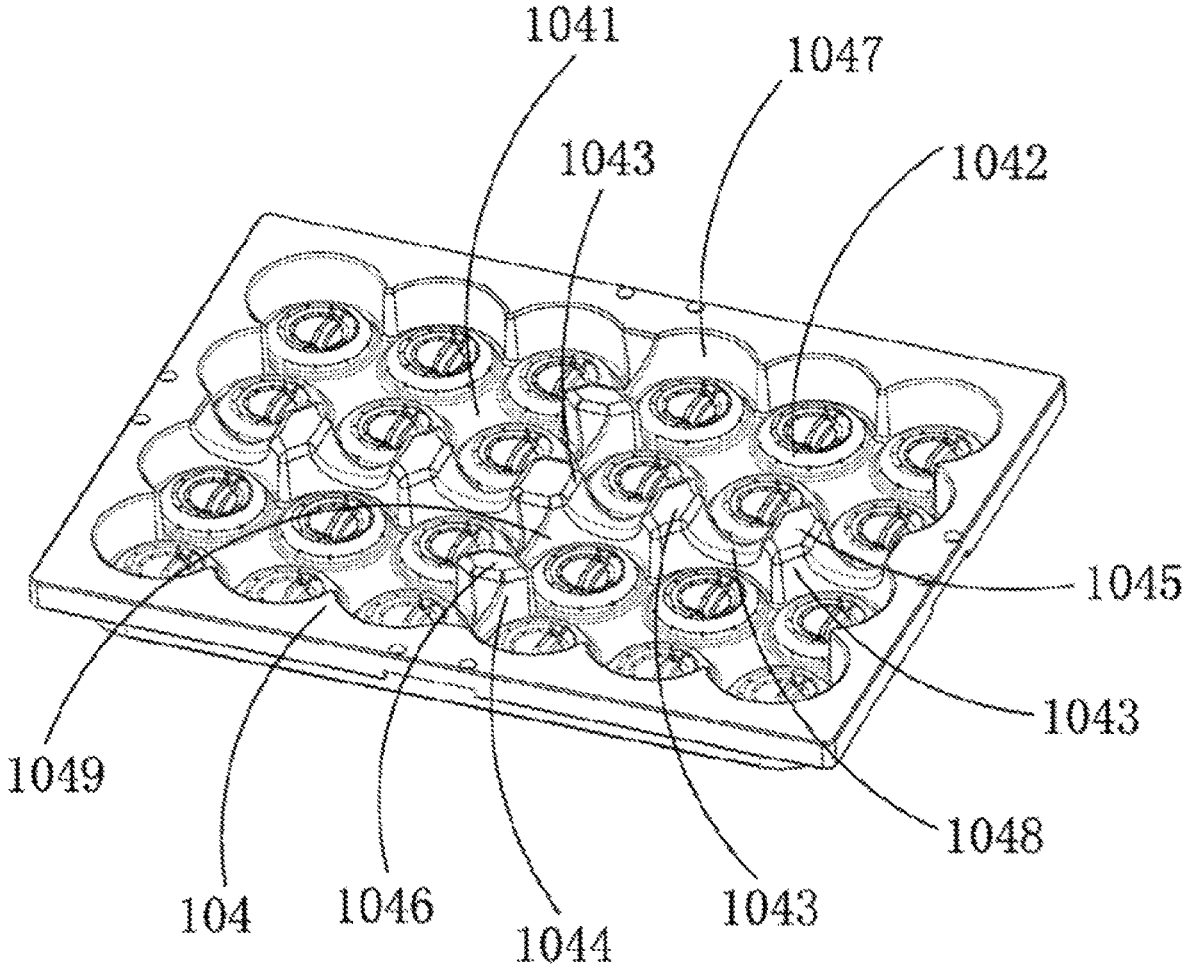
FIG. 3 is a schematic structural diagram of the back of the main template of the transfer device according to the present invention.
Figure 4:
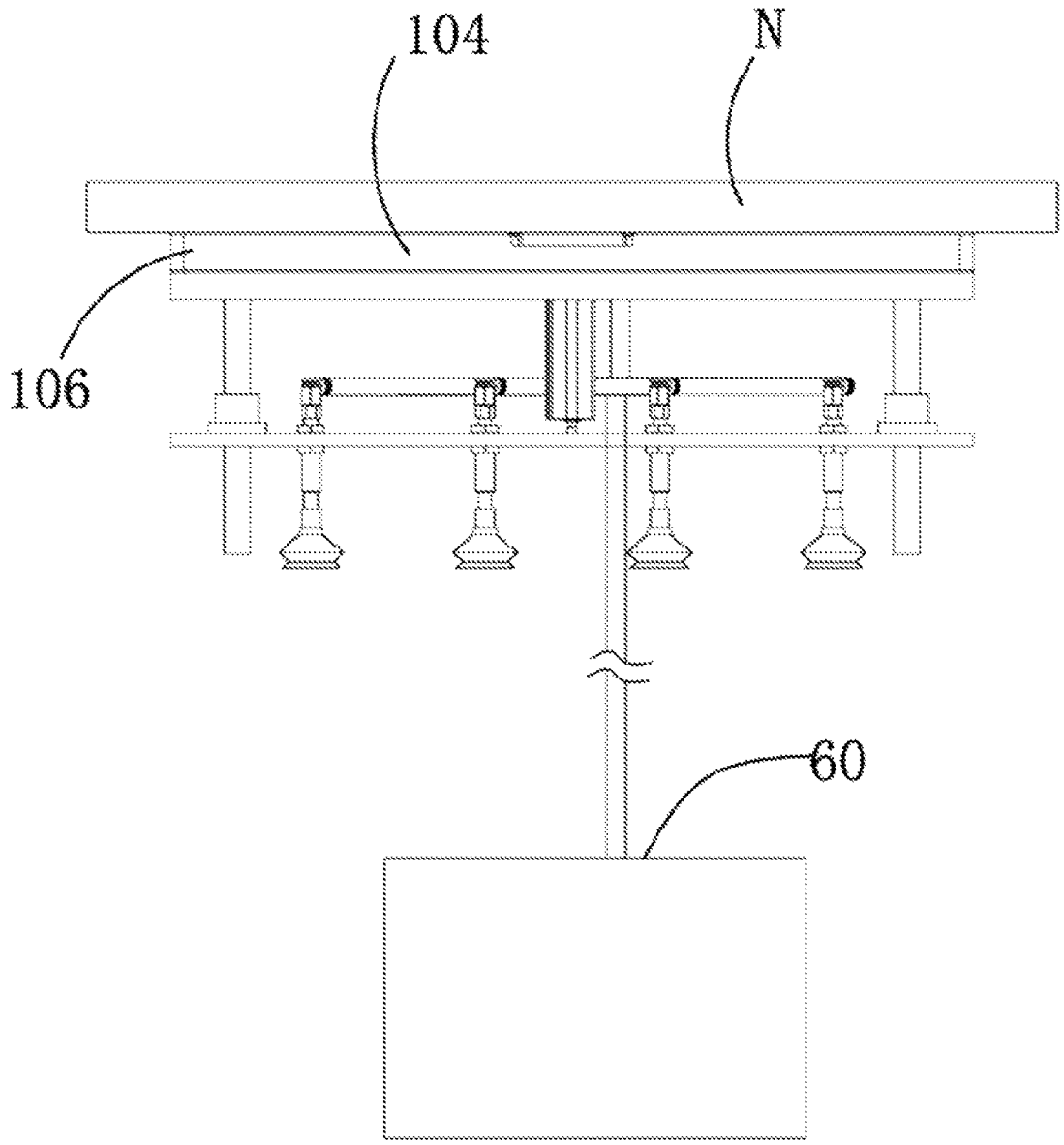
FIG. 4 is a schematic structural diagram of the connection between the vacuumizing system and the transfer device according to the present invention.
Figure 5:
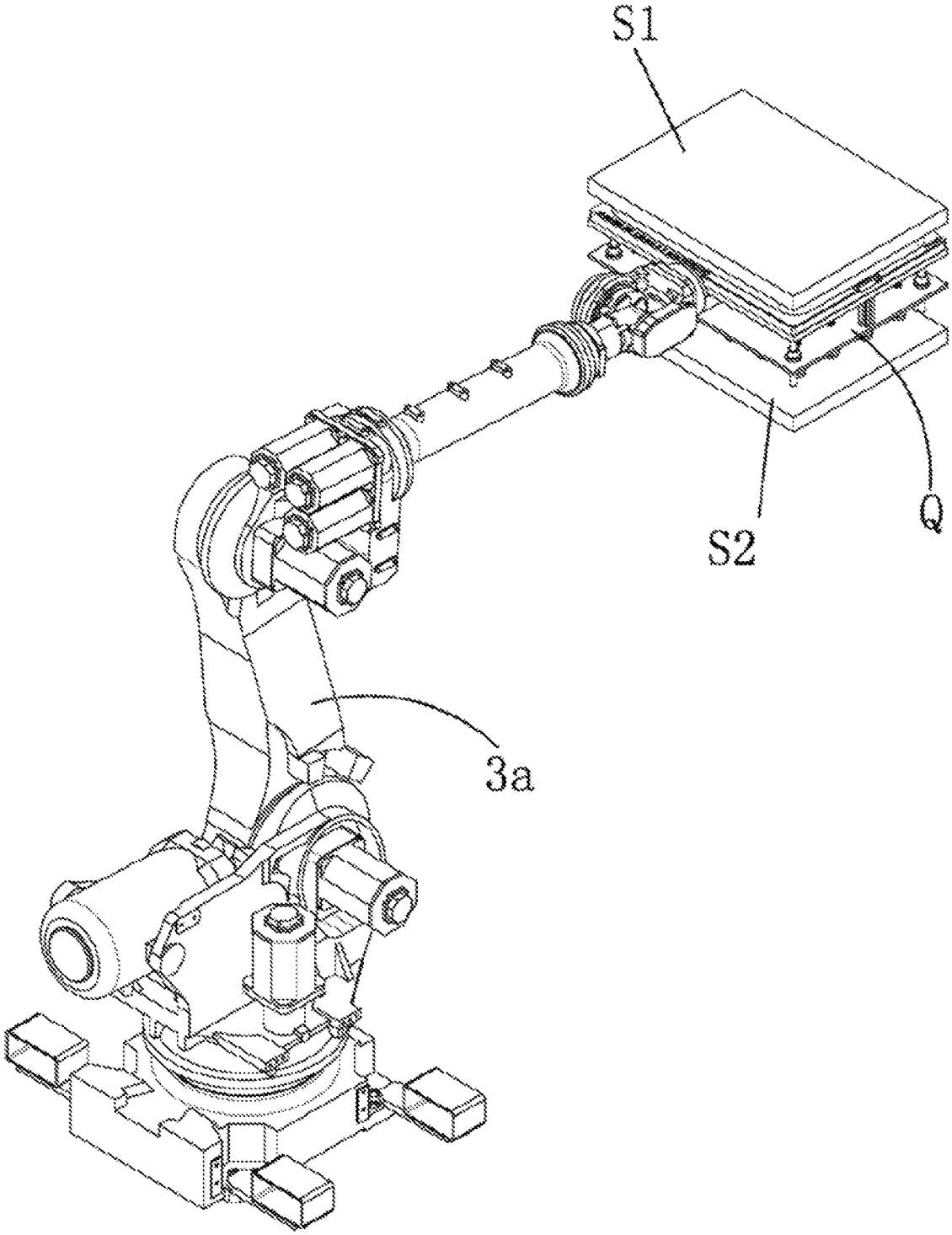
FIG. 5 is a schematic structural diagram after the transfer device is installed on the robot according to the present invention.
Figure 6:
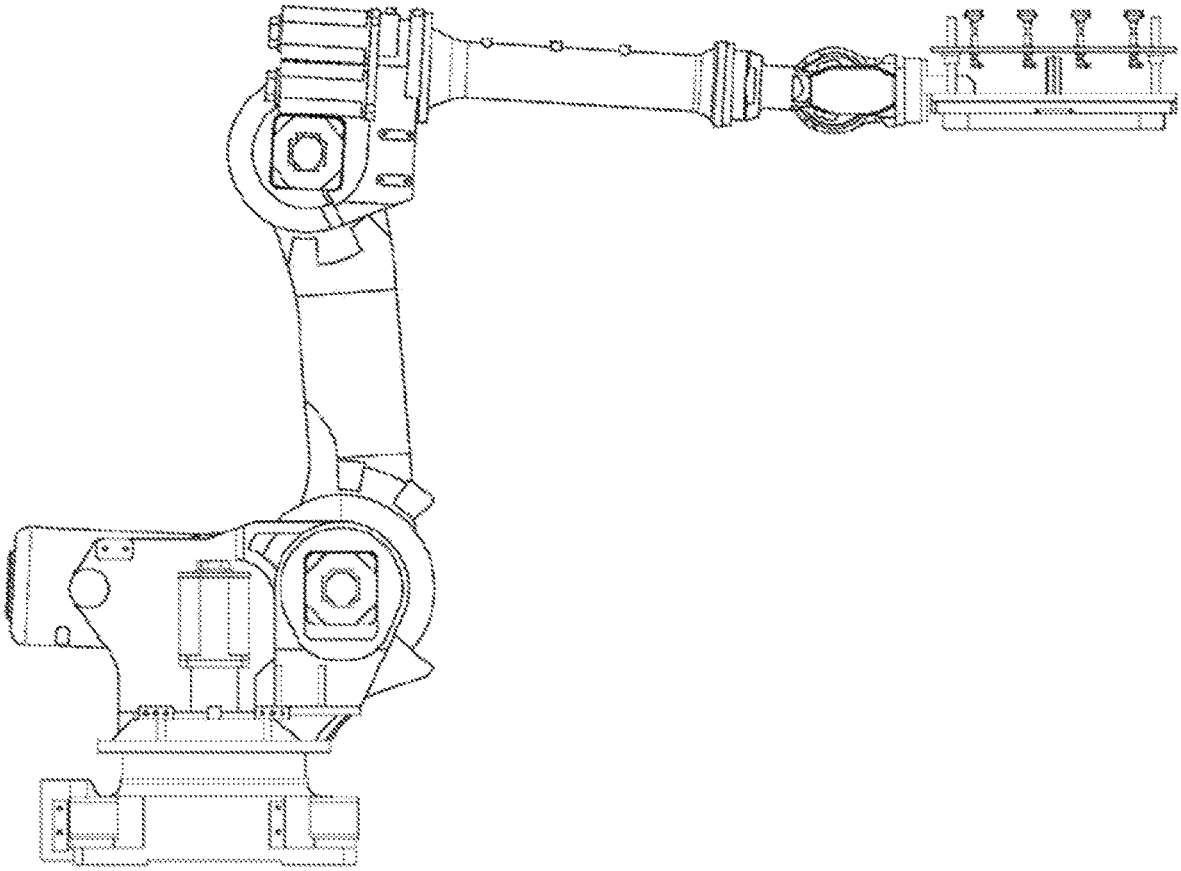
FIG. 6 is a schematic structural diagram of a state I of the transfer device according to the present invention.
Figure 7:
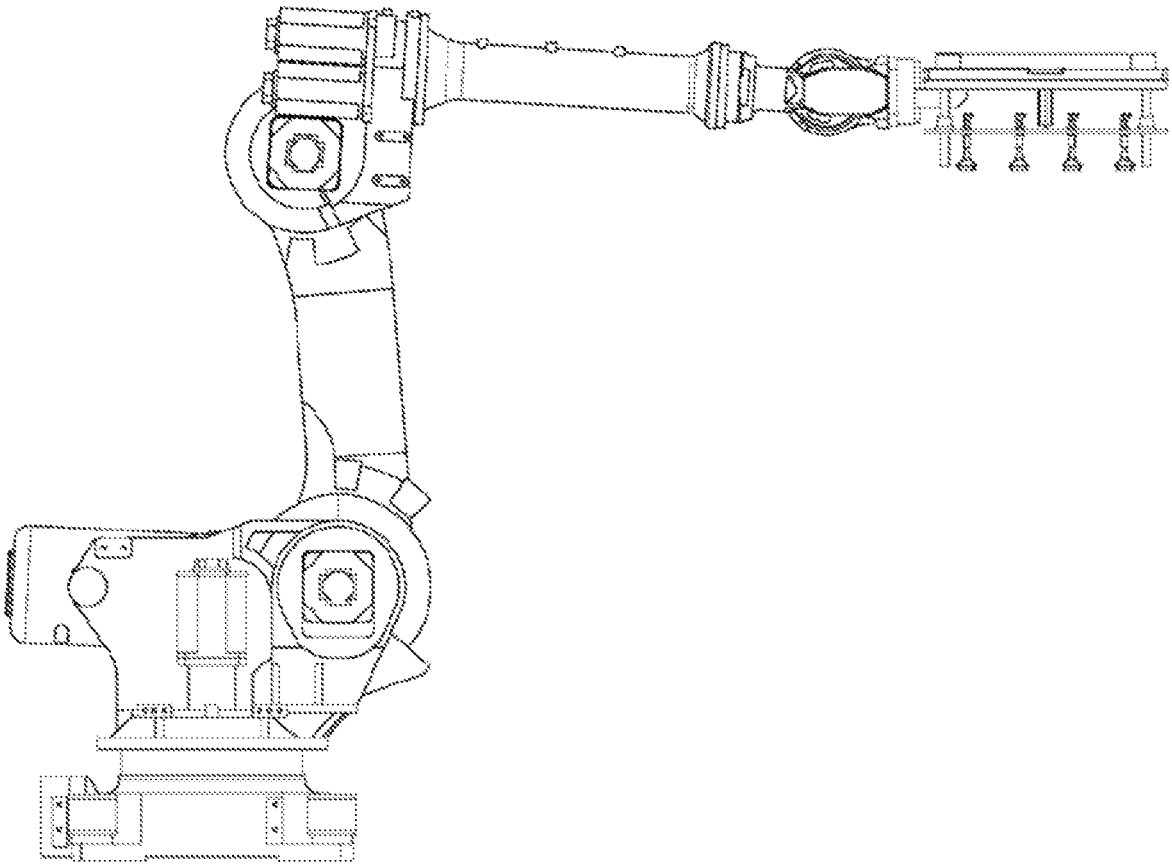
FIG. 7 is a schematic structural diagram of a state II of the transfer device according to the present invention.

As shown in FIGS. 2-3, a reinforcing support structure is provided at the bottom of the chamber 1041 and is in contact with one surface of the sealing template 105 close to the chamber 1041. Specifically, the reinforcing support structure in the present embodiment comprises several reinforcing support projections I 1043 evenly spaced apart laterally and several reinforcing support projections II 1044 evenly spaced apart longitudinally, the reinforcing support projections I 1043 are disposed on the same straight line and at the lateral central position of the chamber 1041, the reinforcing support projections II 1044 are disposed on the same straight line and at the longitudinal central position of the chamber 1041, the reinforcing support projections I 1043 and the reinforcing support projections II 1044 form a cross, one ends of the reinforcing support projections I 1043 away from the bottom of the chamber 1041 abut against one surface of the sealing template 105 close to the chamber 1041, and one ends of the reinforcing support projections II 1044 away from the bottom of the chamber 1041 abut against one surface of the sealing template 105 close to the chamber 1041.

The reinforcing support projections I 1043 and the reinforcing support projections II 1044 can further improve the structural strength and extend the service life of the sealing template 105.

A support plane I 1045 is provided at the end of each reinforcing support projection I 1043 abutting against the sealing template 105, a support plane II 1046 is provided at the end of each reinforcing support projection II 1044 abutting against the sealing template 105, and the support plane I 1045 and the support plane II 1046 are located within the same horizontal plane.

The support planes can improve the stability and reliability of contacts.

Several sequentially connected curved concaves 1047 are formed on the inner wall of the chamber 1041, and the outermost internal projections 1042 of the above internal projections 1042 correspond, one to one, to the curved concaves 1047.

Furthermore, in the present embodiment, six recessed matching chambers 101 are treated as one region, and four of such regions are provided on the front of the wet pulp transfer mold 10.

Next, two adjacent reinforcing support projections I 1043 are connected via an arc connecting rib I 1048 therebetween, there are two reinforcing support projections II 1044 disposed at the outer sides of the reinforcing support projection I 1043 in the very middle, and each of the reinforcing support projections II 1044 is connected to the reinforcing support projection I 1043 in the very middle via an arc connecting rib II 1049 therebetween.

Furthermore, to facilitate the disassembly and assembly of the connection, the main template 104 and the sealing template 105 in the present embodiment are connected via a removable connection structure. Specifically, the removable connection structure comprises a ring-shaped shoulder 106 arranged on the circumference of the main template 104, the thickness of the ring-shaped shoulder is smaller than the thickness of the main template 104, the back of the main template 104 is flush with the back of the ring-shaped shoulder, each side of the sealing template 105 is provided with locking bolts that run through the side, the locking bolts run through screw holes of the ring-shaped shoulder, locking nuts fit onto the locking bolts, and the locking nuts contact the front of the ring-shaped shoulder.

A receding notch 107 is formed on the front of the ring-shaped shoulder for communication with the screw holes, and the locking nuts are disposed inside the receding notch and contact the bottom surface of the receding notch.

As shown in FIGS. 9-12, the press 2*a* comprises a lower base 2, four vertical guide columns 21 connected to the top of the lower base 2, an upper mold seat 3 connected to the top ends of the four vertical guide columns 21, and a movable lower mold seat 4 disposed right underneath the upper mold seat 3 and movably connected to the vertical guide columns 21, the movable lower mold seat 4 is connected to a press main cylinder 41, the press main cylinder 41 drives the movable lower mold seat 4 to move up and down axially along the vertical guide columns 21, the press main cylinder 41 is fixed to the center of the lower base 2, and at the same time, the telescopic rod of the press main cylinder 41 is connected upward to the center of the bottom surface of the movable lower mold seat 4.

During production, the press main cylinder 41 drives the movable lower mold seat 4 to move up and down in coordination with the vertical guide columns 21, which can improve the stability and reliability of the lifting.

A transfer device Q is installed on the pulp molding robot 3*a*, and the transfer device Q is the above "pulp molding production line." The press 2*a* further comprises an auxiliary rack N arranged between the movable lower mold seat 4 and the upper mold seat 3, and a lifting drive mechanism 5 is provided on the press for driving the auxiliary rack to move up and down vertically. The pulp molding robot forces the transfer device to extend between the movable lower mold seat and the upper mold seat, and the lifting drive mechanism drives the auxiliary rack to contact the transfer device and force the transfer device to vertically move upward or downward.

The auxiliary rack N comprises a horizontally disposed auxiliary push board 1, and the auxiliary push board 1 is made of a metallic material or a non-metallic material. Any material that can meet the strength requirements may be used in the present embodiment.

The auxiliary push board 1 is formed with a polygonal central through hole 11. In a preferred solution, the polygonal central through hole 11 in the present embodiment is an octagonal through hole, which can be formed as a placement for the transfer device, contacts the transfer device, and forces the transfer device to move up and down under the action of the lifting drive mechanism.

Next, the rim of the auxiliary push board 1 is formed with external edges corresponding, one to one, to the hole walls of the octagonal through hole, and the external edges form an octagon.

Next, an arc chamfer I 111 is respectively formed at the upper hole opening and the lower hole opening of the octagonal through hole, and an arc chamfer II 112 is respectively formed at two sides of each external edge.

The arc chamfers can prevent damages to mold fixtures or pulp products due to squeeze.

Each of the two end portions of the auxiliary push board 1 is provided with two cantilever bosses 12, each cantilever boss 12 is formed with a guide round hole 121 that is vertically disposed, and a reinforcing structure 13 is provided between two cantilever bosses 12 provided at the same end portion.

Specifically, the above reinforcing structure 13 comprises a lateral reinforcing rib 131 connected between the two cantilever bosses 12, the lateral reinforcing rib 131 is connected to an outer wall of the auxiliary push board 1, and a longitudinal reinforcing rib 132 is provided in the middle portion of the lateral reinforcing rib 131, and the inner end of the longitudinal reinforcing rib 132 is connected to the outer wall of the auxiliary push board 1.

The auxiliary push board 1, the cantilever bosses 12, the lateral reinforcing rib 131 and the longitudinal reinforcing rib 132 are integrally formed, which can improve the overall structural strength.

The lifting drive mechanism 5 drives the auxiliary push board 1 to move up and down between the movable lower mold seat 4 and the upper mold seat 3. At this moment, under the action of the auxiliary push board 1, the transfer device connected to the robot may be forced to move up or down, i.e., the auxiliary push board 1 fits over the circumference of the wet pulp transfer mold 10 and contacts the ring-shaped shoulder 106, which can improve the output stability of auxiliary pushing force. The robot does not need to further execute the upward or downward pushing action, and the reliability of robot operations can be ensured. At the same time, the service life of the robot is extended, such that the production can continuously and steadily proceed, which further meets the production requirements of enterprises.

The lifting drive mechanism 5 comprises two fixed frames 51 that are respectively fixed to the top of the lower base 2, a cylinder I 52 is fixed inside each fixed frame 51, and telescopic rods of the cylinder I 52 extend upwardly and are connected, one by one, to the middle portion of the lower surface of the lateral reinforcing rib 131.

The fixed frame 51 comprises a rectangular frame and is fixed vertically, a strip hole I 511 is formed in the central region of the top end of the fixed frame 51, a strip hole II 512 is formed in the central region of the bottom end of the fixed frame 51, the telescopic rod of the cylinder I 52 runs through the strip hole I 511 and the top end of the cylinder body of the cylinder I 52 is sleeved with a fixed board 513, the fixed board 513 is arranged on the top surface of the hole opening of the strip hole I 511, several bolts I 514 run through the fixed board 513, the bolts I 514 are in threaded connection with threaded holes at the top of the fixed frame 51, and the bottom end of the cylinder I 52 runs through the strip hole II 512.

The design of strip holes facilitates the movement and adjustment of positions.

When the press operates, the movable lower mold seat 4 moves upward as driven by the press main cylinder 41. Then, the pulp product lower mold on the movable lower mold seat 4 and the pulp product upper mold on the upper mold seat 3 cooperate with each other for processing the pulp product. After the processing is completed, the robot needs to acquire the pulp product, and a mold fixture is installed on the robot to acquire the pulp product and to release the pulp product at the next station by means of the mold fixture. During the acquiring or releasing process, the lifting drive mechanism 5 forces the auxiliary push board 1 to move up and down vertically, i.e., the auxiliary push board 1 fits over the mold fixture and can assist the mold fixture to move up and down, which solves the alarm caused by the robot forcing the mold fixture to move upward or downward.

The work principle of the present embodiment is as follows:

After the molding machine S performs molding extrusion on pulp, the pulp is transferred by the transfer device on the robot into the press. Namely, the wet pulp transfer mold acquires a wet pulp product molded by the molding machine S. At the same time, the transfer device on the robot enters the press and stops at a set position (i.e., between an upper mold and a lower mold). Subsequently, there are two solutions:

The first solution: the wet pulp product is disposed at one side of the upper mold, and the upper mold acquires the wet pulp product through a suction force. At the same time, vacuum chucks move downward to acquire the molded pulp product on the lower mold, and transfer the molded pulp product;

The second solution: the wet pulp product is disposed at one side of the lower mold, and the lower mold acquires the wet pulp product through a suction force. At the same time, vacuum chucks move upward to acquire the molded pulp product on the upper mold, and transfer the molded pulp product.

The pulp molding product processing method comprises the following steps:

S1. Molding, wherein the molding machine S performs molding processing on pulp to make a wet pulp product; the wet pulp product comprises pulp containers, pulp cup lids, and the like;

S2. Transferring, wherein a transfer device Q is installed on the pulp molding robot 3*a*, the transfer device comprises a wet pulp transfer mold provided with a sealed gas chamber therein, the front of the wet pulp transfer mold is provided with at least one recessed matching chamber that can fit over the external of a wet pulp product and is recessed to the sealed gas chamber side, the recessed matching chamber matches the wet pulp product, several interfacing apertures for communicating or connecting the recessed matching chamber with the sealed gas chamber are respectively formed on the inner wall of each recessed matching chamber and the bottom of the recessed matching chamber, the interfacing apertures formed on the inner wall of the recessed matching chamber are evenly distributed in a circle and surround to form at least one circle, the interfacing apertures formed on the bottom of the recessed matching chamber are evenly distributed in a circle and surround to form at least one circle, a moving rack parallel to the wet pulp transfer mold is connected to the back of the wet pulp transfer mold through a guide mechanism, a driver is connected between the back of the wet pulp transfer mold and the moving rack, the driver drives the moving rack to move relative to the wet pulp transfer mold, several evenly spaced vacuum chucks are provided on the moving rack, and the vacuum chucks and the sealed gas chamber are connected to a vacuumizing system, respectively;

The pulp molding robot drives the wet pulp transfer mold to approach the wet pulp product, and the wet pulp product is sucked via vacuum by the wet pulp transfer mold and is forced to move away from the molding machine; and S3. Pressing, wherein a lower mold S2 and an upper mold S1 are installed inside the press 2*a*, the lower mold is disposed underneath the upper mold, the auxiliary rack N of the press is driven by the lifting drive mechanism 5 to fit over the wet pulp transfer mold of the transfer device and force the wet pulp product sucked via vacuum by the wet pulp transfer mold to transfer to the lower mold, i.e., the auxiliary push board fits over the circumference of the main template 104 of the wet pulp transfer mold and contacts the ring-shaped shoulder 106, then the lifting drive mechanism drives the auxiliary push board to move up and down vertically, the lower mold moves upward to approach the upper mold or the upper mold moves downward to approach the lower mold for clamping and then pressing the wet pulp product to obtain a pulp product, the clamping between the lower mold and the upper mold is released, and the pulp product is sucked via vacuum by the upper mold; before the lower mold moves upward to approach the upper mold or the upper mold moves downward to approach the lower mold for the clamping, the driver drives the moving rack to move vertically upward relative to the wet pulp transfer mold and force the vacuum chucks to suck the pulp product via vacuum, and finally, cause the pulp product to move away from the press.

Another operating mode is as follows:

The pulp molding product processing method comprises the following steps:

S1. Molding, wherein the molding machine S performs molding processing on pulp to make a wet pulp product;

S2. Transferring, wherein a transfer device Q is installed on the pulp molding robot 3*a*, the transfer device comprises a wet pulp transfer mold provided with a sealed gas chamber therein, the front of the wet pulp transfer mold is provided with at least one recessed matching chamber that can fit over the external of a wet pulp product and is recessed to the sealed gas chamber side, the recessed matching chamber matches the wet pulp product, several interfacing apertures for communicating or connecting the recessed matching chamber with the sealed gas chamber are respectively formed on the inner wall of each recessed matching chamber and the bottom of the recessed matching chamber, the interfacing apertures formed on the inner wall of the recessed matching chamber are evenly distributed in a circle and surround to form at least one circle, the interfacing apertures formed on the bottom of the recessed matching chamber are evenly distributed in a circle and surround to form at least one circle, a moving rack parallel to the wet pulp transfer mold is connected to the back of the wet pulp transfer mold through a guide mechanism, a driver is connected between the back of the wet pulp transfer mold and the moving rack, the driver drives the moving rack to move relative to the wet pulp transfer mold, several evenly spaced vacuum chucks are provided on the moving rack, and the vacuum chucks and the sealed gas chamber are connected to a vacuumizing system, respectively;

The pulp molding robot drives the wet pulp transfer mold to approach the wet pulp product, and the wet pulp product is sucked via vacuum by the wet pulp transfer mold and is forced to move away from the molding machine; and S3. Pressing, wherein a lower mold and an upper mold are installed inside the press 2*a*, the lower mold is disposed underneath the upper mold, the auxiliary rack N of the press is driven by the lifting drive mechanism 5 to fit over the wet pulp transfer mold of the transfer device and force the wet pulp product sucked via vacuum by the wet pulp transfer mold to transfer to right below the upper mold, i.e., the auxiliary push board fits over the circumference of the main template 104 of the wet pulp transfer mold and contacts the ring-shaped shoulder 106, then the lifting drive mechanism drives the auxiliary push board to move up and down vertically; the upper mold sucks the wet pulp product sucked via vacuum, the lower mold moves upward to approach the upper mold or the upper mold moves downward to approach the lower mold for clamping and then pressing the wet pulp product to obtain a pulp product, the clamping between the lower mold and the upper mold is released, and the pulp product is placed on the lower mold; before the lower mold moves upward to approach the upper mold or the upper mold moves downward to approach the lower mold for the clamping, the driver drives the moving rack to move vertically downward relative to the wet pulp transfer mold and force the vacuum chucks to suck the pulp product via vacuum, and finally, cause the pulp product to move away from the press.

It is claimed:

1. A pulp molding production line comprising at least one molding machine, a pulp molding robot and at least one press, wherein the molding machine, the pulp molding robot and the press are sequentially arranged, characterized in that:

a transfer device is installed on the pulp molding robot, wherein the transfer device acquires a wet pulp product molded by the molding machine and transfers the wet pulp product to the press, and wherein the transfer device acquires a molded pulp product molded by the press and transfers and releases the molded pulp product from the press, the transfer device comprises a wet pulp transfer mold provided with a sealed gas chamber therein, wherein a front portion of the wet pulp transfer mold is provided with at least one recessed matching chamber configured to fit over an exterior of the wet pulp product and the recessed matching chamber is recessed toward the sealed gas chamber, and the recessed matching chamber includes several interfacing apertures connecting the recessed matching chamber with the sealed gas chamber that are respectively formed on an inner wall of and a bottom of the recessed matching chamber, with the interfacing apertures formed on the inner wall of the recessed matching chamber evenly distributed to form at least one circle, and with the interfacing apertures formed on the bottom of the recessed matching chamber evenly distributed to form at least one circle, and the transfer device further comprises a moving rack oriented parallel to the wet pulp transfer mold and disposed behind and connected to a back portion of the wet pulp transfer mold through a guide mechanism, with a driver connected between the back portion of the wet pulp transfer mold and the moving rack to drive the moving rack to move relative to the wet pulp transfer mold, and with several evenly spaced vacuum chucks provided on a side of the moving rack opposite from the wet pulp transfer mold to acquire the molded pulp product from the press, wherein the vacuum chucks and the sealed gas chamber are respectively connected to a vacuumizing system, whereby the transfer device may both transfer the wet pulp product from the front portion of the wet pulp transfer mold to the press and transfer the molded pulp product from the press to the vacuum chucks on the side of the moving rack opposite from the wet pulp transfer mold without repositioning the transfer device.

2. The pulp molding production line according to claim 1, characterized in that the wet pulp transfer mold comprises a main template provided with:

a sealed gas chamber portion on a back of the main template, the sealed gas chamber portion having an opening in communication with the surroundings, several recessed matching chambers arranged on a front of the main template and distributed in an array, with several interfacing apertures connecting the recessed matching chambers with the sealed gas chamber portion formed on an inner wall of and a bottom of each recessed matching chamber, and several internal projections provided at an internal bottom of the sealed gas chamber portion and distributed in an array for one-to-one correspondence to the recessed matching chambers, with the interfacing apertures running through the internal projections, and the wet pulp transfer mold further comprises:

a sealing template configured to close the opening of the sealed gas chamber portion to form the sealed gas chamber.

3. The pulp molding production line according to claim 2, characterized in that a reinforcing support structure is provided at the internal bottom of the sealed gas chamber portion and abuts against the sealing template when the sealing template closes the sealing gas chamber portion.

4. The pulp molding production line according to claim 3, characterized in that:

the reinforcing support structure comprises several reinforcing support projections I evenly spaced apart laterally and several reinforcing support projections II evenly spaced apart longitudinally across the sealed gas chamber portion, the reinforcing support projections I are disposed on a straight line along a lateral central position of the sealed gas chamber portion, the reinforcing support projections II are disposed on another straight line along a longitudinal central position of the sealed gas chamber portion, wherein the reinforcing support projections I and the reinforcing support projections II form a cross, and ends of the reinforcing support projections I away from the internal bottom of the sealed gas chamber portion abut against the sealing template, and ends of the reinforcing support projections II away from the internal bottom of the sealed has chamber portion abut against the sealing template, when the sealing template closes the sealing gas chamber portion.

5. The pulp molding production line according to claim 4, characterized in that:

a support plane I is provided at the end of each reinforcing support projection I abutting against the sealing template, a support plane II is provided at the end of each reinforcing support projection II abutting against the sealing template, and the support plane I and the support plane II are located within the same horizontal plane.

6. The pulp molding production line according to claim 4, characterized in that several sequentially connected concave curves are formed on an inner wall of the sealing gas chamber portion, and the outermost internal projections of the array of internal projections correspond, one to one, to the concave curves.

7. The pulp molding production line according to claim 1, characterized in that the guide mechanism comprises:

several guide columns oriented parallel to each other, wherein one end of each guide column is fixed to the back portion of the wet pulp transfer mold, several guide sleeves fixed within guide sleeve fixing holes provided on the moving rack, wherein each guide sleeve fits over a respective one of the guide columns in a sliding connection.

8. The pulp molding production line according to claim 1, characterized in that two circles of the interfacing apertures are formed on the bottom of the recessed matching chamber, with several of the interfacing apertures evenly distributed in each circle.

9. The pulp molding production line according to claim 1, characterized in that the press comprises a lower base, four vertical guide columns connected to a top of the lower base, an upper mold seat connected to the top ends of the four vertical guide columns, and a movable lower mold seat disposed right underneath the upper mold seat and movably connected to the vertical guide columns, wherein the movable lower mold seat is connected to a press main cylinder, the press main cylinder drives the movable lower mold seat to move up and down axially along the vertical guide columns, and the press further comprises an auxiliary rack arranged between the movable lower mold seat and the upper mold seat, with the auxiliary rack being connected to a lifting drive mechanism.

10. The pulp molding production line according to claim 9, characterized in that the auxiliary rack comprises:

an auxiliary push board, wherein the auxiliary push board is formed with a polygonal central through hole, and each of two end portions of the auxiliary push board is provided with two cantilever bosses, with each cantilever boss formed with a guide round hole that is vertically disposed, and a reinforcing structure extending between the two cantilever bosses provided at each end portion; wherein the reinforcing structure comprises a lateral reinforcing rib connected between the two cantilever bosses, with the lateral reinforcing rib being connected to an outer wall of the auxiliary push board, and a longitudinal reinforcing rib adjoining a middle portion of the lateral reinforcing rib, with an inner end of the longitudinal reinforcing rib being connected to the outer wall of the auxiliary push board.

11. The pulp molding production line according to claim 10, characterized in that the lifting drive mechanism comprises:

two fixed frames that are respectively fixed to the top of the lower base, and a cylinder I fixed inside each fixed frame, with telescopic rods of each cylinder I extending upwardly and connected to a middle portion of a lower surface of a respective one of the lateral reinforcing ribs.

12. The pulp molding production line according to claim 11, characterized in that the fixed frame comprises a rectangular frame and is fixed vertically, a strip hole I is formed in a central region of the top end of the fixed frame, a strip hole II is formed in a central region of the bottom end of the fixed frame, the telescopic rod of the cylinder I runs through the strip hole I and a top end of a cylinder body of the cylinder I is sleeved with a fixed board, wherein the fixed board is arranged on a top surface of the hole opening of the strip hole I, several bolts I run through the fixed board, the bolts I are in threaded connection with threaded holes at the top end of the fixed frame, and a bottom end of the cylinder I runs through the strip hole II.

13. A pulp molding product processing method for a pulp molding production line, the method comprising:

molding, wherein a molding machine performs molding processing on pulp to make a wet pulp product;

transferring, wherein (i) a transfer device installed on a pulp molding robot comprises:

a wet pulp transfer mold provided with a sealed gas chamber therein, wherein a front portion of the wet pulp transfer mold is provided with at least one recessed matching chamber configured to fit over an exterior of the wet pulp product and the recessed matching chamber is recessed toward the sealed gas chamber, the recessed matching chamber including several interfacing apertures connecting the recessed matching chamber with the sealed gas chamber that are respectively formed on an inner wall of and a bottom of the recessed matching chamber, with the interfacing apertures formed on the inner wall of the recessed matching chamber evenly distributed to form at least one circle, and with the interfacing apertures formed on the bottom of the recessed matching chamber evenly distributed to form at least one circle; and a moving rack oriented parallel to the wet pulp transfer mold and disposed behind and connected to a back portion of the wet pulp transfer mold through a guide mechanism, with a driver connected between the back portion of the wet pulp transfer mold and the moving rack to drive the moving rack to move relative to the wet pulp transfer mold, and with several evenly spaced vacuum chucks provided on a side of the moving rack opposite from the wet pulp transfer mold to acquire the molded pulp product from the press, wherein the vacuum chucks and the sealed gas chamber are respectively connected to a vacuumizing system; and (ii) the pulp molding robot drives the wet pulp transfer mold to approach the wet pulp product, and the wet pulp product is sucked via vacuum through the several interfacing apertures of the recessed matching chamber and transferred away from the molding machine; and pressing, wherein (i) a press comprises:

a lower mold and an upper mold, with the lower mold disposed underneath the upper mold;

an auxiliary rack driven by a lifting drive mechanism to fit over the wet pulp transfer mold of the transfer device; and (ii) the auxiliary rack forces the wet pulp product sucked via vacuum by the wet pulp transfer mold to transfer to the lower mold, either the lower mold moves upward to approach the upper mold or the upper mold moves downward to approach the lower mold for clamping the wet pulp product, and then pressing the wet pulp product to obtain a pulp product, wherein before the lower mold moves upward to approach the upper mold or the upper mold moves downward to approach the lower mold for the clamping and without repositioning the transfer device outside of the press, the driver drives the moving rack to move vertically upward relative to the wet pulp transfer mold and forces the vacuum chucks to suck a previously pressed molded pulp product via vacuum, and then the transfer device withdraws from the press.

14. A pulp molding product processing method for a pulp molding production line, the method comprising:

molding, wherein a molding machine performs molding processing on pulp to make a wet pulp product;

transferring, wherein (i) a transfer device installed on a pulp molding robot comprises:

a wet pulp transfer mold provided with a sealed gas chamber therein, wherein a front portion of the wet pulp transfer mold is provided with at least one recessed matching chamber configured to fit over an exterior of the wet pulp product and the recessed matching chamber is recessed toward the sealed gas chamber, the recessed matching chamber including several interfacing apertures connecting the recessed matching chamber with the sealed gas chamber that are respectively formed on an inner wall of and a bottom of the recessed matching chamber, with the interfacing apertures formed on the inner wall of the recessed matching chamber evenly distributed to form at least one circle, and with the interfacing apertures formed on the bottom of the recessed matching chamber evenly distributed to form at least one circle;

a moving rack oriented parallel to the wet pulp transfer mold and connected to a back portion of the wet pulp transfer mold through a guide mechanism, with a driver connected between the back portion of the wet pulp transfer mold and the moving rack, wherein the driver drives the moving rack to move relative to the wet pulp transfer mold, and with several evenly spaced vacuum chucks provided on the moving rack on a side opposite from the wet pulp transfer mold to acquire the molded pulp product from the press, wherein the vacuum chucks and the sealed gas chamber are respectively connected to a vacuumizing system; and (ii) the pulp molding robot drives the wet pulp transfer mold to approach the wet pulp product, and the wet pulp product is sucked via vacuum through the several interfacing apertures of the recessed matching chamber and transferred away from the molding machine; and pressing, wherein (i) a press comprises:

a lower mold and an upper mold, with the lower mold disposed underneath the upper mold;

an auxiliary rack driven by a lifting drive mechanism to fit over the wet pulp transfer mold of the transfer device; and (ii) the auxiliary rack forces the wet pulp product sucked via vacuum by the wet pulp transfer mold to transfer to the upper mold, either the lower mold moves upward to approach the upper mold or the upper mold moves downward to approach the lower mold for clamping the wet pulp product, and then pressing the wet pulp product to obtain a pulp product, wherein before the lower mold moves upward to approach the upper mold or the upper mold moves downward to approach the lower mold for the clamping and without repositioning the transfer device outside of the press, the driver drives the moving rack to move vertically downward relative to the wet pulp transfer mold and forces the vacuum chucks to suck a previously pressed molded pulp product via vacuum, and then the transfer device withdraws from the press.

* * * * *